US011512560B2

(12) United States Patent
Wardley et al.

(10) Patent No.: US 11,512,560 B2
(45) Date of Patent: Nov. 29, 2022

(54) DOWNHOLE TOOL

(71) Applicant: Ardyne Holdings Limited, Aberdeen (GB)

(72) Inventors: Michael Wardley, Aberdeen (GB); George Telfer, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 0 days.

(21) Appl. No.: 17/263,938

(22) PCT Filed: Jul. 31, 2019

(86) PCT No.: PCT/GB2019/052140

§ 371 (c)(1),
(2) Date: Jan. 28, 2021

(87) PCT Pub. No.: WO2020/025950

PCT Pub. Date: Feb. 6, 2020

(65) Prior Publication Data

US 2021/0317723 A1 Oct. 14, 2021

(30) Foreign Application Priority Data

Aug. 1, 2018 (GB) ..... 1812535

(51) Int. Cl.
*E21B 34/14* (2006.01)

(52) U.S. Cl.
CPC ..... *E21B 34/14* (2013.01); *E21B 2200/06* (2020.05)

(58) Field of Classification Search
CPC ..... E21B 34/14; E21B 2200/06; E21B 23/06; E21B 29/005; E21B 34/10; E21B 34/102
See application file for complete search history.

(56) References Cited

U.S. PATENT DOCUMENTS 10,458,203 B2 * 10/2019 Mailand ..... E21B 34/08
2012/0312540 A1 * 12/2012 Lefebvre ..... F16K 31/084 166/319

(Continued)

FOREIGN PATENT DOCUMENTS

WO WO 2016/172736 A1 10/2016
WO WO 2016/205725 A1 12/2016
WO WO 2017/046613 A1 3/2017

OTHER PUBLICATIONS

Intellectual Property Office of the UK Patent Office; Combined Search and Examination Report for GB1812535.1; dated Nov. 30, 2018; pp. 1-5; Intellectual Property Office of the UK Patent Office; Newport, United Kingdom.

(Continued)

*Primary Examiner* — Michael R Wills, III
(74) *Attorney, Agent, or Firm* — Law Office of Jesse D. Lambert, LLC

(57) ABSTRACT

A downhole tool which allows the selective operation of a second fluid pressure activated tool below a first fluid pressure activated tool on a tool string in a well. The downhole tool has a piston sleeve moveable inside a cylindrical body between a first position in which a small flow area is provided through the tool and a second position in which a larger flow area is provided. The piston sleeve is held in the first position by a magnet and the first fluid pressure activated tool can be operated by increasing fluid pressure above the tool up to a cracking pressure level which matches the pulling strength of the magnet. Increasing fluid pressure to the cracking pressure therefore selectively moves the piston sleeve to the second position in which the second fluid pressure activated tool can be operated. The downhole tool is resettable.

16 Claims, 5 Drawing Sheets

(56) References Cited

U.S. PATENT DOCUMENTS

| | | | |
|---|---|---|---|
| 2015/0300124 | A1 | 10/2015 | Mailand et al. |
| 2016/0305228 | A1 | 10/2016 | Mailand et al. |
| 2017/0058632 | A1 | 3/2017 | deBoer |

OTHER PUBLICATIONS

International Bureau of WIPO; International Preliminary Report on Patentability for PCT/GB2019/052140; dated Feb. 2, 2021; pp. 1-6; International Bureau of WIPO; Geneva, Switzerland.

* cited by examiner

DOWNHOLE TOOL

The present invention relates to apparatus and methods for operating downhole tools and in particular, though not exclusively, to a valve which facilitates selective operation of a fluid pressure actuated tool when run on a tool string with other fluid pressure activated tools.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. Current techniques to achieve this may require multiple trips into the well, for example: to pull the wear bushing from the wellhead; to pull the seal assembly from the wellhead; to set a bridge plug to support cement; to cut the casing above the plug; to pull the cut casing from the well; and create a cement plug to cement across to the well bore wall. The cement or other suitable plugging material forms a permanent barrier to meet the legislative requirements.

Each trip into a well takes substantial time and consequently significant costs. Combined casing cutting and pulling tools have been developed so that the cutting and pulling of the casing can be achieved on a single trip. Such a tool is the TRIDENT® System to the present Applicants, Ardyne Technologies Limited. This tool is described in WO2017/046613. The tool comprises a gripping mechanism and a cutting mechanism both are fluid activated with the gripping mechanism first being set to anchor slips to the casing and on additional fluid pressure the cutting blades radially expand to contact the casing. The drill string is rotated from surface to achieve a cutting action, there being a bearing inside the gripping mechanism to allow through rotation of the string past the slips.

This casing cutting and pulling tool is limited to procedures in which the drill string can be rotated. In circumstances such as when retrieving a seal assembly this is not possible as rotation of the string may disengage the seal assembly from its running tool.

It is known to use a motor such as a mud motor to rotate a casing cutter downhole. This removes the requirement to rotate the entire drill string from surface. However, we cannot simply replace the bearing with a motor as pumping fluid through the drill string to set the gripping mechanism will turn the motor and the cutting blades, which will have deployed, will cut the casing. While this is acceptable if the tool is positioned at a location in which a cut is required, if the gripping mechanism is being used to pull a cut section of casing from an upper end, deployment of the cutter blades while the string is rotating will inadvertently cut the suspended casing section below the anchor point.

It is therefore an object of the present invention to provide a downhole tool which allows selective operation of a second fluid pressure activated tool arranged on a tool string below a first fluid pressure activated tool.

It is a further object of the present invention to provide a method of selectively operating a second fluid pressure activated tool arranged on a tool string below a first fluid pressure activated string.

According to a first aspect of the present invention there is provided a downhole tool comprising:

a substantially cylindrical body having a central bore and being configured to connect into a tool string;

a piston sleeve located in the bore, the piston sleeve being moveable by the action of fluid pressure in the bore between a first position providing a first flow area through the bore and a second position providing a second flow area through the bore; characterised in that:

the second flow area is greater than the first flow area;

the piston sleeve is biased towards the first position; and the piston sleeve is held against the cylindrical body by a magnet in the first position.

In this way, pressure activated tools located above the downhole tool can be operated until there is sufficient pressure applied to the piston sleeve for it to be pulled free of the magnet. Once pulled off the magnet, the piston sleeve can move to the second position thereby allowing sufficient fluid flow through the downhole tool to actuate pressure activated tools below the downhole tool. The downhole tool may be considered as a valve.

Preferably, the magnet is a permanent magnet. There may be a plurality of magnets arranged around the tool body. The magnet is preferably mounted on the cylindrical body. In this way, the tool is simply constructed with only mechanical parts and solenoids or other arrangements using varying magnetic fields which would require power and/or connections to surface are not needed.

Preferably, the piston sleeve is biased towards the first position by a spring. In this way, the spring can be used to return the downhole tool to the first position if fluid flow is stopped to reduce fluid pressure through the tool. The downhole tool can therefore be cycled between the first and second positions by varying fluid pressure within the tool. This makes the downhole tool resettable.

Preferably, a pull strength of the magnet (how much weight in kg the magnet can hold) and the first flow area are selected to determine a cracking pressure for the downhole tool, the downhole tool moving from the first position to the second position when the cracking pressure is exceeded. In this way, fluid pressure activated tools can be operated above the downhole tool with activation pressures below the cracking pressure.

By using a magnet instead of a spring to set the cracking pressure, the force holding the piston sleeve to the magnet decreases as soon as the cracking pressure is applied and the sleeve moves away from the magnet. If a spring were used this force increases as the two surfaces are separated. Accordingly, with magnets it is possible to 'switch' from a high closing force to a low closing force.

Preferably the pull strength of the magnet is greater than the force of the spring. In this way, the spring is a weak spring and used only to return the piston sleeve to the first position and has no influence on the cracking pressure.

Preferably, the second flow area is at least ten times greater than the first flow area. More preferably, the first flow area is greater than zero. In this way, the downhole tool does not prevent fluid flow in the first position. This advantageously removes the requirement to provide a seal in the flow path. The downhole tool has therefore less wear.

In an embodiment, the downhole tool includes a check valve, wherein the check valve allows fluid flow though the tool in a direction opposite to the direction of movement of the piston sleeve between the first and second positions. In this way, the downhole tool can be run-in a well in the first position with the check valve allowing the drill string to fill above the tool.

In a further embodiment, there is a j-slot and pin arrangement between the piston sleeve and tool body. More preferably, the j-slot is continuous providing a plurality of first and second pin locations adjacent each other with at least one third pin location, the third pin location providing a third position for the piston sleeve which locks the sleeve in a position in which fluid flow is through the second flow area.

In this way, the tool can be fixed to provide the larger flow area so that the tool can be pulled from the well and allow the fluid in the string above the tool to drain through the tool.

Preferably, the downhole tool includes a first fluid pressure activated tool which activates at a first fluid pressure level and a second fluid pressure activated tool which activates at a second fluid pressure level, the downhole tool being located between the first fluid pressure activated tool and the second fluid pressure activated tool and wherein the first fluid pressure level is lower than a fluid pressure required to overcome a pull strength of the magnet.

According to a second aspect of the present invention there is provided a method of selectively operating a second fluid pressure activated tool located below a first fluid pressure activated tool in a tool string, comprising the steps:

(a) mounting a downhole tool according to the first aspect between the first and the second fluid pressure activated tools;

(b) running the tool string into a well with the piston sleeve in the first position;

(c) increasing fluid pressure through the tool string until it reaches a first pressure level sufficient to operate the first fluid pressure activated tool and activating the first fluid pressure activated tool;

on selecting to operate the second fluid pressure activated tool:

(d) further increasing the fluid pressure through the tool string until it reaches a cracking pressure level sufficient to overcome a pull strength of the magnet and moving the piston sleeve to the second position;

(e) flowing fluid through the second flow area of the downhole tool to increase fluid pressure at the second fluid pressure activated tool to a second fluid pressure level sufficient to operate the second fluid pressure activated tool and activating the second fluid pressure activated tool;

characterised in that the cracking pressure level is greater than the first pressure level.

In this way, the second fluid pressure activated tool is prevented from operating until a fluid pressure is applied which is sufficient to overcome the pull strength of the magnet. Thus, as long as the fluid pressure is kept below this predetermined pressure, the cracking pressure, the second fluid pressure activated tool will not operate.

The first pressure level may be greater than or equal to the second pressure level. Alternatively, the second pressure level may be greater than or equal to the first pressure level. In this way, the downhole tool can be used to allow tools activated at any pressure level to be mounted in any order on a tool string.

Preferably, the method includes the step of stopping fluid flow through the tool string and resetting the downhole tool to the first position. This allows multiple activation of tools on the tool string.

Preferably, the method includes opening a check valve in the downhole tool at step (b) to allow the tool string to fill above the downhole tool through the check valve. This prevents the string requiring to fill through the first flow area.

Preferably, the method includes the step of cycling the downhole tool between the first and second positions. More preferably, the method may include the steps of cycling the tool into a third position in which the downhole tool is locked to provide fluid flow through the downhole tool through the second flow area and pulling the tool string out of the well. This allows fluid in the tool string to drain through the downhole tool more quickly.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. Furthermore, relative terms such as", "lower", "upper, "up", "down" and the like are used herein to indicate directions and locations as they apply to the appended drawings and will not be construed as limiting the invention and features thereof to particular arrangements or orientations. Likewise, the term "inlet" shall be construed as being an opening which, dependent on the direction of the movement of a fluid may also serve as an "outlet", and vice versa.

There will now be described, by way of example only, various embodiments of the invention with reference to the drawings, of which:

Figure 1A:
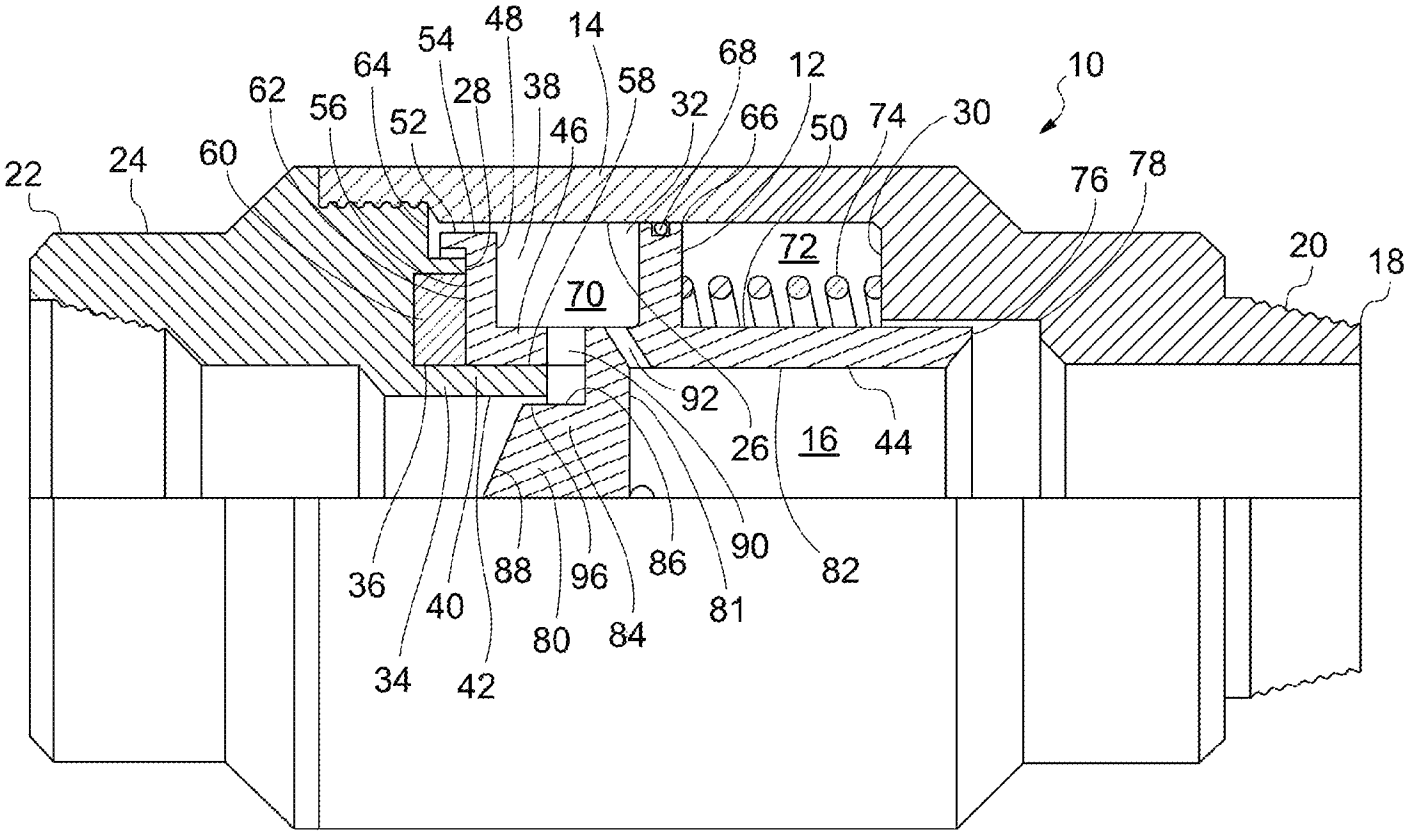
FIG. 1A is a sectional view of a downhole tool in a first position according to an embodiment of the present invention.

Referring initially to FIG. 1A of the drawings there is illustrated a downhole tool, generally indicated by reference numeral 10, including a piston sleeve 12 moveable in a cylindrical body 14 according to an embodiment of the present invention.

Cylindrical body 14 is of two-part construction to allow the piston sleeve 12 to be held within its central bore 16. At a first end 18 of the body 14 there is a pin section 20 and at an opposing second end 22 there is a corresponding box section 24 for connecting the tool 12 in a tool, work or drill string as is known in the art. The body 14 has an inner surface 26 from which extend first 28 and second 30 opposing shoulders providing a pocket 32. First shoulder 28 has lip 34 extending from an outer edge 36 which partially covers the pocket 32 to give an annular recess 38 towards the end 22. The lip 34 is parallel to the central bore 16 and provides a wall 40 with an inner cylindrical surface 42.

The piston sleeve 12 is also substantially cylindrical in shape with a central cylindrical wall 44. At an end 46 of the cylindrical wall 44, there is an annular plate 48 extending perpendicularly from an outer surface 50 of the wall 44. The plate 48 provides a further lip 52 directed towards the second end 22 at a distal edge 54. In a first position, as illustrated in FIG. 1A, the annular plate 48 and the end 46 of the wall 44 sit within recess 38. An inner surface 82 of the cylindrical wall 44 meets the inner surface 58 of wall 40 on the body 14. The upper surface 56 of plate 48 is held to a face 62 of a magnet 60 embedded in the first shoulder 28. The further lip 52 also locates in a rim 64 on the shoulder 28 at the inner surface 26 of the body 14. Magnet 60 is preferably a collection of magnets 60*a-d* arranged on and around the shoulder 28. In the first position the magnet 60 is entirely enclosed by the body 14 and the piston sleeve 12.

At a location along the outer surface 40 of the cylindrical wall 44 there is a dividing wall 66 which extends across the pocket 32 to reach the inner surface 26 of the body 14. The dividing wall 66 may also be considered as an annular plate. There is a o-ring seal 68 between the wall 66 and the inner surface 26. The dividing wall 66 creates a first chamber 70 bounded by the inner surface 26, dividing wall 66, outer surface 50 and annular plate 48. The first chamber 70 has a fixed annular volume. There is also a second chamber 72 bounded by the inner surface 26, second shoulder 30, outer surface 50 and dividing wall 66. The second chamber contains a biasing element which is shown as a spring 74. The second chamber 72 has a variable volume by virtue of the cylindrical wall 44 sitting inside the second shoulder 30, so that it can travel along the central bore 16 until its lower edge 76 meets a third shoulder 78 on the body 14 which is directed towards the second end 22.

Extending from the inner surface 82 of the cylindrical wall 44 between the plate 48 and the dividing wall 66 there is an annular plate 81 on which a nipple 80 protrudes therefrom on the central axis. Plate 81 obstructs the central bore 16. Nipple 80 provides a cylindrical element 84 with an outer surface 86 which is parallel to and faces the inner surface 82. The cylindrical element 84 has a conical end 88 directed towards the second end 22 of the tool 10.

Above the plate 81, towards the second end 22, there are a plurality of inlet ports 90 located through the cylindrical wall 44. Typically, there will be four inlet ports 90 spaced equidistantly around the cylindrical wall 44. The inlet ports 90 provide access to the first chamber 70. Below the plate 81, towards the first end 18, there are a plurality of outlet ports 92 located through the cylindrical wall 44. Typically, there will be four outlet ports 92 spaced equidistantly around the cylindrical wall 44. The outlet ports 92 are arranged at an angle to the central bore 16 so that they access the first chamber 70 near the dividing wall 66. In the preferred embodiment the inlet ports 90 have a larger combined cross-sectional flow area than that of the outlet ports 92.

In the first position, a portion of the wall 40 lies between the inner surface 82 of the cylindrical wall 44 and the outer surface 86 on the cylindrical element 84, while not sitting over the inlet ports 90. The diameter of the wall 40 on its inner surface 94 is greater than the diameter of the outer surface 86 of the cylindrical element 84. This provides an annular gap 96 between the body 14 and the piston sleeve 12. The cross-sectional flow area of the annular gap 96 is small compared to the combined cross-sectional flow area of the outlet ports 92. The cross-sectional flow area of the annular gap 96 may be at least ten times smaller than the combined cross-sectional flow area of the outlet ports 92. In a preferred embodiment: the cross-sectional flow area of the annular gap 96 is 0.04 square inches; the combined cross-sectional flow area of the outlet ports 92 is 0.70 square inches; and, the cross-sectional of the flow area of the central bore at its narrowest point at the wall 40 is 1.54 square inches.

For the preferred embodiment, the magnet(s) 60 have a pull strength of around 1000 lbs. The spring 74 has an expanded support weight of around 500 lbs with a compressed support weight of about 1000 lbs.

Figure 2:
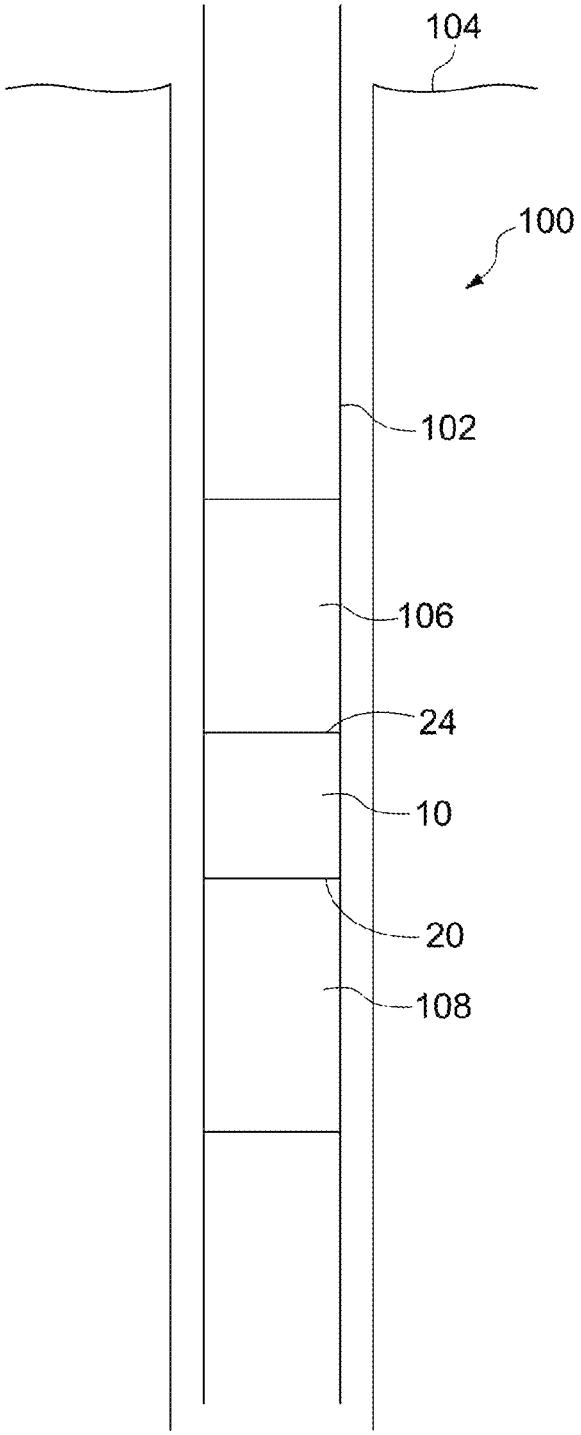
FIG. 2 is a schematic illustration of a downhole tool on a tool string in a well according to an embodiment of the present invention.

In use, the downhole tool 10 is used in a well 100 as illustrated in FIG. 2, according to an embodiment of the present invention. Well 10 is a conventional well as would be understood in the water, gas or oil mining industries. The well 100 may be being formed by drilling, may be being completed for production, may be having an intervention operation performed or may be being abandoned. Thus, the downhole tool 10 may be used in any process throughout the lifetime of a well 100. The downhole tool 10 is located on a tool string 102, by connection via the box 24 and pin 20 sections, which is run from the surface 104 of the well 100. Those skilled in the art will appreciate that the surface 104 can be on land or subsea and there will be associated equipment on the surface 104 (not shown) which will seal the well 100 and run the tool string 102 therefrom. Above the downhole tool 10 there is located a first fluid pressure activated tool 106. Below the downhole tool 10 there is located a second fluid pressure activated tool 108. Such fluid pressure activated tools are well known in the art. Other tools may be arranged on the tool string as required.

The first and second fluid pressure activated tools 106, 108 are run-in in an unactivated configuration. The downhole tool 10 is run-in in the first position as shown in FIG. 1A. The piston sleeve 12 is held against the magnet 60 and the flow through the central bore 16 is limited as the flow has to pass through the small gap 96.

The magnet 60 is selected to have a pull strength greater than the activation fluid pressure of the first fluid pressure activated tool 106. In this way, the piston sleeve 12 is firmly held in place by the strong magnet 60. Using the magnet of the preferred embodiment it would take approx. 1000 lbs of force to pull the piston sleeve 12 off the magnet 60. When the first fluid pressure activated tool 106 requires to be activated, fluid is pumped from surface 104 through the string 102. The pumping of very low volumes of fluid through the small gap 96 should be sufficient to activate the first fluid pressure activated tool 106. An example may be a pump rate of 30 gpm (gallons per minute) from surface being sufficient to activate a tool 106 above the downhole tool 10 with an activation pressure of, say, 500 psi.

As long as the fluid pressure at the gap 96 remains below the pull strength of the magnet 60, the first fluid pressure activated tool 106 can be operated without fear that the second fluid pressure activated tool 108 will inadvertently activate. The small flow rate permitted through the gap 96 causes a significant pressure drop through the tool 10 such that there is no fluid pressure increase below the tool 10 to operate the second fluid pressure activated tool 108.

When the second fluid pressure activated tool 108 requires to be activated, slightly higher volumes of fluid are pumped through the string 104 to the tool 10. These higher volumes e.g. 50 gpm when pumped through the small flow area at gap 96 generate a sufficiently higher pressure (approx. 1350 psi) which will allow the piston sleeve 12 to move away from the magnet 60. Thus, the pull strength of the magnet 60 has been reached and the fluid pressure may be considered as the cracking pressure of the downhole tool 10. Fluid entering the first chamber 70 now acts on the piston area 98 of the dividing wall 66. This will cause the piston sleeve 12 to move downwards, compressing the spring 74 and reducing the volume of the second chamber 72. As the piston sleeve 12 moves downwards the nipple 80 clears the inner wall 40, the gap 96 disappears and fluid can flow directly from the central bore 16 through the inlet ports 90 to the first chamber 70. Fluid exits the chamber 70 through the outlet ports 92 with a much higher flow rate, in our example e.g. 250 gpm, due to the increased cross-sectional flow area in the fluid flow path. This higher flow rate through the central bore 16 below the tool 10, provides sufficient pressure to activate the second fluid pressure activated tool 108.

Figure 1B:
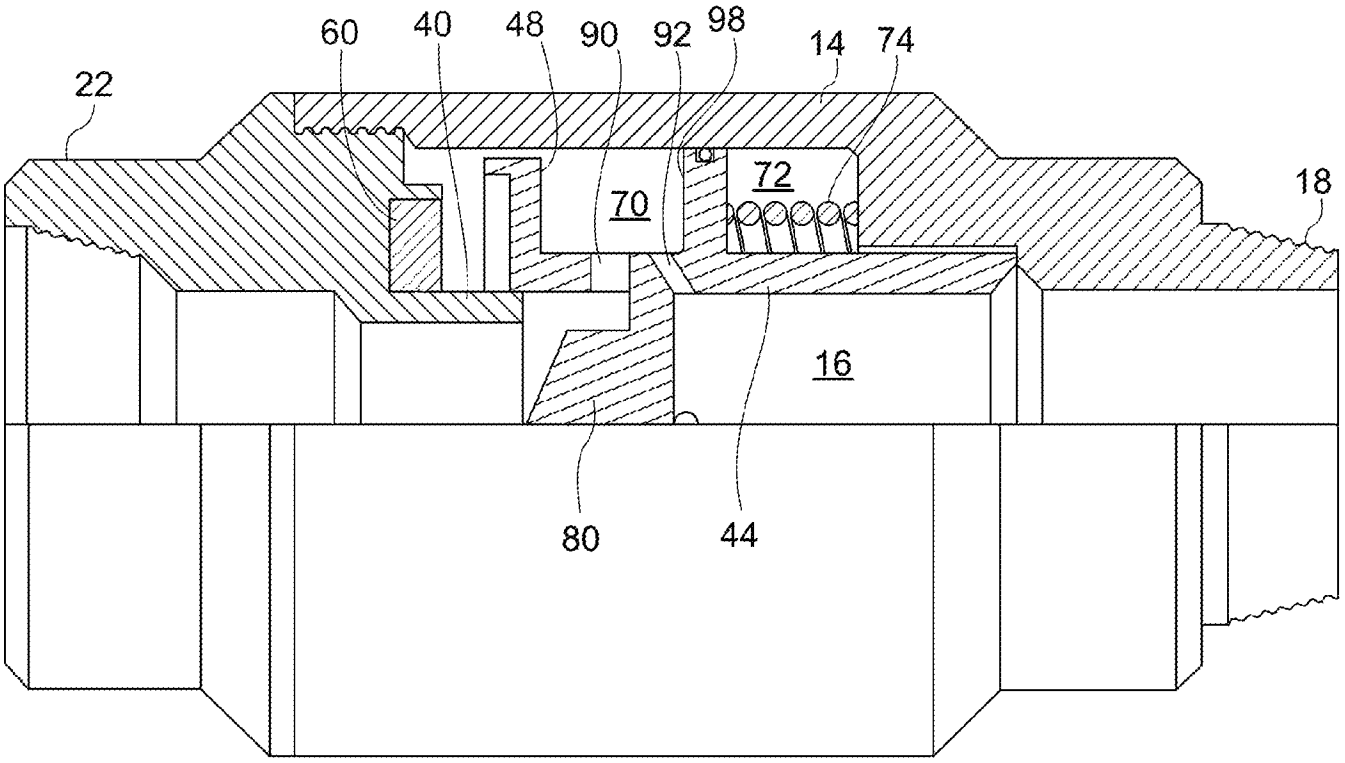
FIG. 1B is a sectional view of the downhole tool of FIG. 1A in a second position.

The tool 10 will now be in a second position as shown in FIG. 1B. Here it is seen that the piston sleeve 12 has moved towards the first end 18, the magnet 60 and the plate 48 have separated and a larger flow path is formed around the nipple 80 via the inlet ports 90, first chamber 70 and outlet ports 92.

When the pumps are switched off, fluid flow through the string 102 is stopped. Fluid pressure will reduce in the tool 10 to below a level at which the spring 74 force will cause the spring 74 to expand to its original size. This expansion of the spring 74, will push the piston sleeve 12 upwards towards the second end 22. When the plate 48 reaches the vicinity of the magnet 60 it will be drawn to it and the piston sleeve 12 will affix to the magnet 60. This returns the tool 10 to the first position as shown in FIG. 1A.

These method steps can be repeated any number of times as the downhole tool 10 can be reset. In this way, the downhole tool 10 can be considered as a valve which is resettable.

The magnet 60 is a permanent magnet as is known in the art. It has a north and south pole and can be orientated to attract the metal material of the piston sleeve 12. It will be appreciated that the magnet 60 may be a plurality of magnets, the magnets may be located on the piston sleeve 12 rather than the body 14 or there may be magnets oppositely arranged on the piston sleeve 12 and the body 14. These permanent magnets 60 require no power supply or connection to surface which makes them easier to use than electrically powered magnets providing variable magnetic fields and those that are based on being operated by solenoids.

It is noted that the spring 74 is a relatively weak spring in comparison to the pull strength of the magnet 60. This ensures that the piston sleeve 12 will move rapidly once the pull strength has been overcome. Equally it means that the second fluid pressure activated tool 108 can be activated at any desired pressure level which may be the same, lower or higher than the pressure activation level of the first fluid pressure activated tool 106.

Figure 3A:
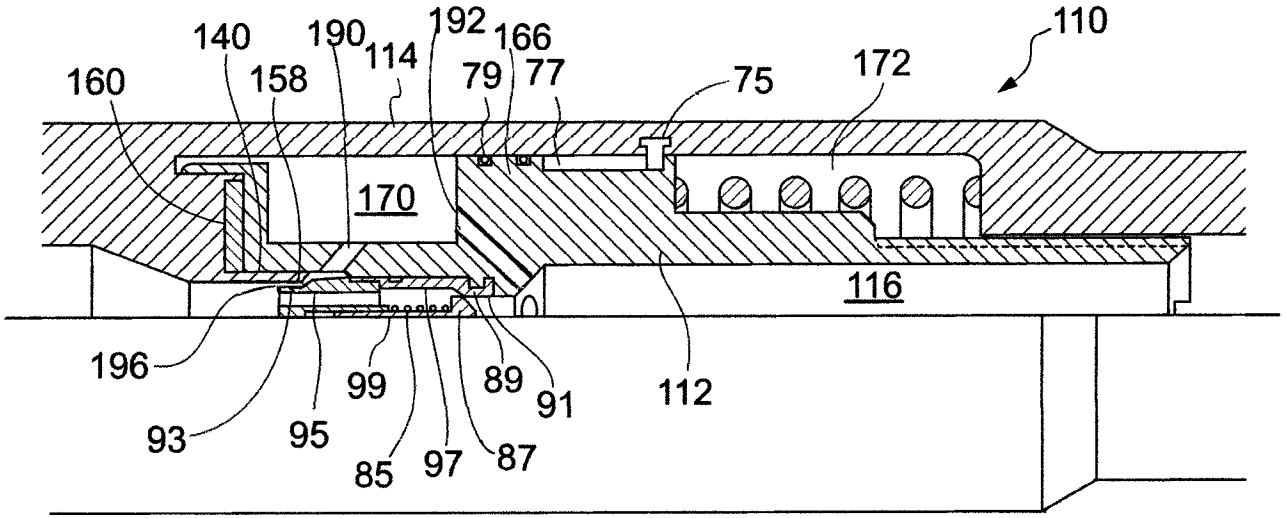
FIG. 3A is a sectional view of a downhole tool in a first position according to a further embodiment of the present invention.
Figure 3B:
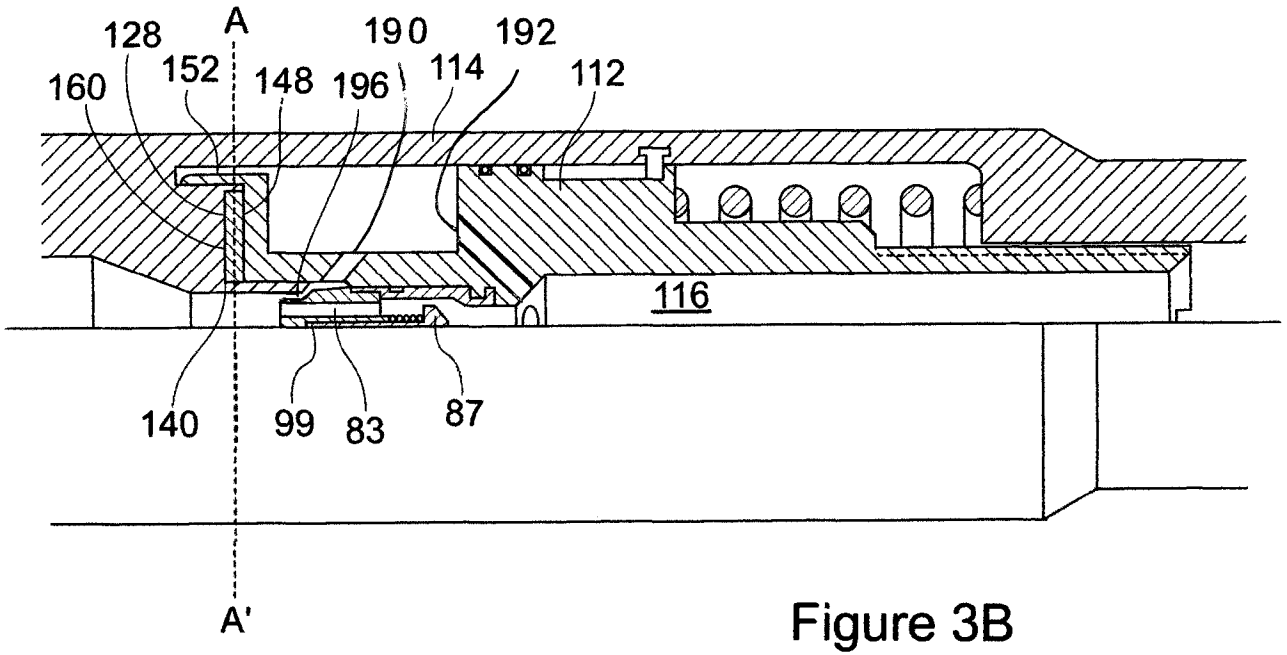
FIG. 3B is a sectional view of the downhole tool of FIG. 3A when being run in a well.

Reference is now made to FIGS. 3A and 3B of the drawings which illustrate features which can be considered together or independently as further embodiments of the present invention. Like parts to those of FIGS. 1A and 1B have been given the same reference numerals with the addition of '100' to aid clarity.

The first additional feature of the tool 110 in FIG. 3A is the change to the plate 81 and the nipple 80. These are removed and replaced with a check valve 99. Check valve 99 has a substantially cylindrical body 97 including an upper wall 95 which now provides the outer surface 93 which forms the gap 196 with the inner surface 158 of wall 140. The lower end 91 has a retainer 89 for a poppet 87 located on the central axis. Poppet 87 is biased by a spring 85 against the retainer 89, as shown in FIG. 3A. With the piston sleeve 112 in the first position, the check valve 99 is closed when the tool 110 is assembled on the string. Thus fluid flow is limited to taking the flow path through the narrow gap 196 to pass through the tool 110. However, as is known in the art, when the string is run in a well, see FIG. 2, the well is full of fluid and the string and tools must pass through the fluid as they enter the well. This requires the fluid to fill the bore of the string and the central bore 116 of the tool 110. In the tool 10, this would be difficult as the fluid would need to take a reverse path through the outlet ports 92, first chamber 70, inlet ports 90 and annular gap 96. The annular gap 96 restricts the speed at which the drill string can be run. The check valve 99 overcomes this as, when the drill string is run-in, the static fluid will act on the poppet 87 and force it upwards against the bias of the spring 85 and away from the retainer 89. This is as illustrated in FIG. 3B. A flow path 83 is now created around the poppet 87 which provides a greater cross-sectional flow area than the gap 196 and thus the fluid in the well can be transferred to a position above the tool 110 quickly as the tool 110 is run in the well. When the tool 110 has reached the location for the fluid pressure activated tools to be operated, movement of the string is stopped. The spring 85 will now bias the poppet 87 back against the retainer 89, so closing the check valve 99. Fluid pumped from surface must now pass through the annular gap 196 and the tool 110 will operate as described hereinbefore.

When the string and tool 110 is pulled from the well, if the downhole tool is in the first position, as shown in FIG. 3A, fluid in the string above the tool 110 will now have to drain through the narrow flow area of the gap 196. This will limit the speed at which the string can be pulled. It would therefore be advantageous to have the tool 110 in the second position, as illustrated in FIG. 1B, so that the larger flow area through the outlet ports 192 can be used to drain the fluid through the tool. A second feature is illustrated on the tool 110 to achieve this.

Figure 4:
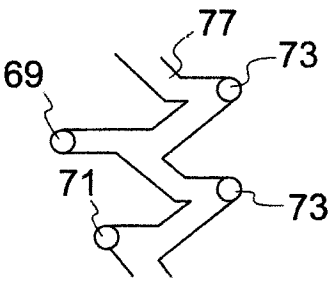
FIG. 4 is a schematic illustration of the path of a j-slot in the downhole tool of FIG. 3A.

Dividing wall 166 now has an increased length to provide an outer surface 79 on which is machined a slot 77. Slot 77 is a j-slot arrangement as is known in the art and part illustrated in FIG. 4. A pin 75 is located through the body 114 to locate in the slot 77. On run-in the pin 75 will be at a first gully 73 on the slot 77. When the tool 110 is moved to the second position the piston sleeve 112 will have moved downwards and the pin 75 will guide and rotate the sleeve 112 so that the pin 75 now rests in a second gully 71. The tool 110 can be cycled between the first and second positions with the pin 75 moving around the sleeve 112 in the slot 77. When the tool 110 is to be removed, the tool is cycled until the pin 75 arrives in an extended gully 69. In this location the sleeve 112 is moved further downwards than the second position so that the inlet 190 and outlet 192 ports are clear of the nipple 80 or check valve 99. Gully 69 is shaped so as to prevent movement of the pin 75 out of the gully 69 so that the tool 110 is fixed i.e. effectively locked, in the second position. This ensures that the larger flow area is available for draining the string as the tool 110 is pulled from the well.

Figure 5:
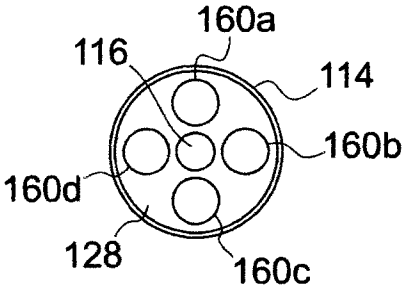
FIG. 5 is a cross-sectional view of the downhole tool of FIG. 3A at the section A-A'.

Now referring to FIG. 5, there is illustrated four permanent magnets 160*a-d* arranged around the body 114 and embedded in the shoulder 128. While it is known that a disadvantage in using magnets is that they attract metallic debris and remove it from any fluid, so potentially blocking inlets 190 or filling the chamber 170, the tools 10, 110 have features to negate this. As illustrated in FIG. 3B, in the first position used on run-in the magnets 160 are entirely bounded by the shoulder 128, inner wall 140, plate 148 and further lip 152. This prevents debris being attracted to the magnet 160. In the second position, see FIG. 1B, the plate 48 is used as a wall to separate the chamber 70 from the magnet 60 and it is spaced apart therefrom. Additionally, the cylindrical wall 44 still overlaps the inner wall 40, preventing a direct fluid path being created to the magnet 60.

The principle advantage of the present invention is that it provides a downhole tool which allows the selective operation of a second fluid pressure activated tool below a first fluid pressure activated tool.

It is a further advantage of at least one embodiment of the present invention that it provides a downhole tool which prevents accidental actuation of a second fluid pressure activated tool below a first fluid pressure activated tool by providing a high cracking pressure in the downhole tool.

It is a still further advantage of the present invention is that it provides a downhole tool which allows the selective operation of a second fluid pressure activated tool below a first fluid pressure activated tool which itself is fluid pressure operated.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended. For example, it will be appreciated that other shapes of piston sleeves could be used.

We claim:

1. A downhole tool comprising:

a substantially cylindrical body having a central bore and being configured to connect into a tool string;

a piston sleeve located in the bore, the piston sleeve being moveable by the action of fluid pressure in the bore between a first position providing a first flow area through the bore and a second position providing a second flow area through the bore;

the second flow area is greater than the first flow area;

the piston sleeve is biased towards the first position by a spring;

the piston sleeve is held against the cylindrical body by a magnet in the first position;

a pull strength of the magnet and the first flow area are selected to determine a cracking pressure for the downhole tool, the downhole tool moving from the first position to the second position when the cracking pressure is exceeded; and the pull strength of the magnet is greater than the force of the spring.

2. The downhole tool according to claim 1 wherein the magnet is a permanent magnet.

3. The downhole tool according to claim 1 wherein a plurality of magnets are arranged around the tool body.

4. The downhole tool according to claim 1 wherein the second flow area is at least ten times greater than the first flow area.

5. The downhole tool according to claim 1 wherein the first flow area is greater than zero.

6. The downhole tool according to claim 1 wherein the downhole tool includes a check valve, wherein the check valve allows fluid flow though the tool in a direction opposite to the direction of movement of the piston sleeve between the first and second positions.

7. The downhole tool according to claim 1 wherein there is a j-slot and pin arrangement between the piston sleeve and tool body.

8. The downhole tool according to claim 7 wherein the j-slot is continuous providing a plurality of first and second pin locations adjacent each other with at least one third pin location, the third pin location providing a third position for the piston sleeve which locks the sleeve in a position in which fluid flow is through the second flow area.

9. A downhole assembly comprising:

a first fluid pressure activated tool which activates at a first fluid pressure level;

a second fluid pressure activated tool which activates at a second fluid pressure level; and a downhole tool, the downhole tool comprising:

a substantially cylindrical body having a central bore and being configured to connect into a tool string;

a piston sleeve located in the bore, the piston sleeve being moveable by the action of fluid pressure in the bore between a first position providing a first flow area through the bore and a second position providing a second flow area through the bore;

the second flow area is greater than the first flow area;

the piston sleeve is biased towards the first position by a spring;

the piston sleeve is held against the cylindrical body by a magnet in the first position;

a pull strength of the magnet and the first flow area are selected to determine a cracking pressure for the downhole tool, the downhole tool moving from the first position to the second position when the cracking pressure is exceeded; and the pull strength of the magnet is greater than the force of the spring;

the downhole tool being located between the first fluid pressure activated tool and the second fluid pressure activated tool and wherein the first fluid pressure level is lower than a fluid pressure required to overcome the pull strength of the magnet.

10. A method of selectively operating a second fluid pressure activated tool located below a first fluid pressure activated tool in a tool string, comprising the steps:

(a) mounting a downhole tool in the tool string between the first and the second fluid pressure activated tools, said downhole tool comprising:

a substantially cylindrical body having a central bore and being configured to connect into the tool string;

a piston sleeve located in the bore, the piston sleeve being moveable by the action of fluid pressure in the bore between a first position providing a first flow area through the bore and a second position providing a second flow area through the bore;

the second flow area is greater than the first flow area;

the piston sleeve is biased towards the first position by a spring;

the piston sleeve is held against the cylindrical body by a magnet in the first position;

a pull strength of the magnet and the first flow area are selected to determine a cracking pressure for the downhole tool, the downhole tool moving from the first position to the second position when the cracking pressure is exceeded; and the pull strength of the magnet is greater than the force of the spring;

(b) running the tool string into a well with the piston sleeve in the first position;

(c) increasing fluid pressure through the tool string until it reaches a first pressure level sufficient to operate the first fluid pressure activated tool and activating the first fluid pressure activated tool;

on selecting to operate the second fluid pressure activated tool:

(d) further increasing the fluid pressure through the tool string until it reaches the cracking pressure level sufficient to overcome the pull strength of the magnet and moving the piston sleeve to the second position;

(e) flowing fluid through the second flow area of the downhole tool to increase fluid pressure at the second fluid pressure activated tool to a second fluid pressure level sufficient to operate the second fluid pressure activated tool and activating the second fluid pressure activated tool;

characterised in that the cracking pressure level is greater than the first pressure level.

11. The method according to claim 10 wherein the first pressure level is greater than or equal to the second pressure level.

12. The method according to claim 10 wherein the second pressure level is greater than or equal to the first pressure level.

13. The method according to claim 10 wherein the method includes the step of stopping fluid flow through the tool string and resetting the downhole tool to the first position.

14. The method according to claim 10 wherein the method includes opening a check valve in the downhole tool at step (b) to allow the tool string to fill above the downhole tool through the check valve.

15. The method according to claim 10 wherein the method includes the step of cycling the downhole tool between the first and second positions.

16. The method according to claim 15 wherein the method includes the steps of cycling the tool into a third position in which the downhole tool is locked to provide fluid flow through the downhole tool through the second flow area and pulling the tool string out of the well.

* * * * *